US006816695B2

(12) United States Patent
Nakai et al.

(10) Patent No.: US 6,816,695 B2
(45) Date of Patent: Nov. 9, 2004

(54) METHOD AND DEVICE FOR DEVELOPMENT FOR AN IMAGE FORMING APPARATUS

(75) Inventors: Hiroshi Nakai, Kanagawa (JP); Tomoyuki Ichikawa, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/383,750

(22) Filed: Mar. 10, 2003

(65) Prior Publication Data

US 2003/0210930 A1 Nov. 13, 2003

(30) Foreign Application Priority Data

Mar. 11, 2002 (JP) ..... 2002-065282

(51) Int. Cl.[7] ..... G03G 15/09
(52) U.S. Cl. ..... 399/267; 399/274
(58) Field of Search ..... 399/267, 272, 399/273, 274

(56) References Cited

U.S. PATENT DOCUMENTS 3,991,713 A * 11/1976 Whited
6,030,736 A 2/2000 Ikegami et al.
6,468,706 B2 10/2002 Matsuda et al.
6,526,246 B2 2/2003 Iwata et al.
6,542,707 B2 4/2003 Muramatsu et al.
2003/0108362 A1 * 6/2003 Ohjimi et al. ..... 399/267

FOREIGN PATENT DOCUMENTS

JP 08015904 A * 1/1996 ..... G03B/9/08
JP 10090950 A * 4/1998 ..... G03G/15/08
JP 10-228175 8/1998
JP 2000-267337 9/2000
JP 2000-347442 12/2000

* cited by examiner

*Primary Examiner*—Susan Lee
(74) *Attorney, Agent, or Firm*—Oblon, Spivak, McClelland, Maier & Neustadt, P.C.

(57) ABSTRACT

A developing method of the present invention develops a latent image formed on an image carrier with a developing device including at least a developer carrier and a doctor blade. The developer carrier magnetically causes a two-ingredient type developer made up of toner grains and magnetic carrier grains to deposit thereon and conveys it to a developing zone where the developer carrier faces the image carrier. The doctor blade regulates the thickness of the developer forming a layer on the developer carrier. The ratio of a dynamic torque W (kgf·cm) to act on the developer while the developing device is in operation to an amount of toner grains M (g) contained in the developer is selected to be $4.0\times10^{-2}$ or below.

14 Claims, 7 Drawing Sheets

FIG. 5A

| | DYN. TORQUE W (kgf·cm) | AMOUNT OF TONER M (g) | W/M ($\times 10^2$) | (q1/m1) / (q2/m2) | 10,000 PRINTS | |
|---|---|---|---|---|---|---|
| | | | | | BACKGROUND CONTAMINATION | TONER SCATTERING |
| EX. 1 | 0.80 | 21 | 3.8 | 0.77 | 4 | 5 |

FIG. 5B

| 20,000 PRINTS | | 50,000 PRINTS | |
|---|---|---|---|
| BACKGROUND CONTAMINATION | TONER SCATTERING | BACKGROUND CONTAMINATION | TONER SCATTERING |
| 3 | 4 | 3 | 4 |

FIG. 6A

| | DYN TORQUE W (kgf·cm) | AMOUNT OF TONER M (g) | W/M ($\times 10^2$) | (q1/m1) / (q2/m2) | 10,000 PRINTS | |
|---|---|---|---|---|---|---|
| | | | | | BACKGROUND CONTAMINATION | TONER SCATTERING |
| EX. 2 | 0.77 | 30 | 2.6 | 0.77 | 4 | 4 |
| EX. 3 | 0.74 | 25 | 3.0 | 0.77 | 4 | 4 |
| EX. 4 | 0.76 | 30 | 2.5 | 0.77 | 4 | 5 |
| EX. 5 | 0.76 | 30 | 2.5 | 0.85 | 4 | 5 |
| EX. 6 | 0.77 | 30 | 2.6 | 0.71 | 4 | 4 |
| EX. 7 | 0.77 | 30 | 2.6 | 0.74 | 5 | 4 |
| EX. 8 | 0.76 | 30 | 2.5 | 0.73 | 5 | 4 |
| EX. 9 | 0.76 | 30 | 2.5 | 0.73 | 5 | 4 |
| EX. 10 | 0.76 | 30 | 2.5 | 0.82 | 5 | 5 |
| COM.EX. 1 | 0.82 | 15 | 5.5 | 0.77 | 3 | 5 |
| COM.EX. 2 | 0.78 | 17.5 | 4.5 | 0.77 | 3 | 4 |
| COM.EX. 3 | 0.87 | 21 | 4.1 | 0.77 | 4 | 4 |

FIG. 6B

| 20,000 PRINTS | | 50,000 PRINTS | |
|---|---|---|---|
| BACKGROUND CONTAMINATION | TONER SCATTERING | BACKGROUND CONTAMINATION | TONER SCATTERING |
| 4 | 4 | 3 | 3 |
| 4 | 4 | 3 | 3 |
| 4 | 5 | 4 | 5 |
| 4 | 5 | 4 | 4 |
| 4 | 4 | 4 | 4 |
| 4 | 4 | 4 | 4 |
| 5 | 4 | 4 | 4 |
| 5 | 4 | 5 | 4 |
| 5 | 5 | 5 | 5 |
| 1 | 5 | | |
| 2 | 4 | 1 | 3 |
| 3 | 3 | 1 | 2 |

METHOD AND DEVICE FOR DEVELOPMENT FOR AN IMAGE FORMING APPARATUS

BACKGROUND OF THE INVENTION

1. Field of the Invention

The present invention relates to a copier, printer, plotter, facsimile apparatus or similar electrophotographic image forming apparatus and more particularly to a developing method using a dry two-ingredient type developer and a device for practicing the same.

2. Description of the Background Art

An image forming apparatus, in many cases, uses a magnet brush type developing device operable with a dry two-ingredient type developer, i.e., a mixture of magnetic carrier grains and toner grains. This type of developing device usually includes a rotatable sleeve in which a magnet roller provided with a plurality of magnetic poles is disposed. The magnetic carrier grains on which the toner grains are deposited are magnetically retained on the sleeve and conveyed to a developing zone thereby.

More specifically, the toner grains and carrier grains are agitated together and charged to opposite polarities by friction. In the developing zone, the toner grains thus charged are transferred to a latent image opposite in polarity to the toner grains, thereby producing a corresponding toner image. The toner grains are charged most by a doctor blade or metering member that rubs the toner grains and carrier grains in a small gap. However, the doctor blade causes stress to act on the toner grains at the same time as it charges them by friction. The stress causes an outside substance covering the individual toner grain to be buried in the toner grain, thereby lowering the fluidity of the toner. Consequently, the charge distribution of the toner grains becomes irregular and brings about various image defects including background contamination as well as toner scattering.

In light of the above, Japanese Patent Laid-Open Publication Nos. 5-119518 and 11-143115, for example, propose to adjust the composition of the outside substance, which covers the toner grains, such that the matter is buried little in toner grains despite the stress mentioned above. Also, Japanese Patent Laid-Open Publication No. 8-54750 proposes a specific grain size and a specific viscoelasticity of toner grains.

However, none of the above proposals is a versatile measure for various kinds of developing devices because they cope with the stress from the toner grain side. More specifically, although the expected effect may be achieved with some kind of developing device, it cannot be fully achieved with, e.g., a developing device of the kind exerting heavier stress or a small-size developing device storing only a small amount of developer.

Technologies relating to the present invention are also disclosed in, e.g., Japanese Patent Laid-Open Publication Nos. 10-228175, 2000-267337 and 2000-347442.

SUMMARY OF THE INVENTION

It is an object of the present invention to provide a developing method capable of reducing the burying of an outside substance in toner grains without regard to the kind of a developing device even when the toner grains are agitated over a long time, thereby insuring high image quality, and a device for practicing the same.

It is another object of the present invention to provide an image forming apparatus using the above developing device for thereby maintaining image quality high.

A developing method of the present invention develops a latent image formed on an image carrier with a developing device including at least a developer carrier and a doctor blade. The developer carrier magnetically causes a two-ingredient type developer made up of toner grains and magnetic carrier grains to deposit thereon and conveys it to a developing zone where the developer carrier faces the image carrier. The doctor blade regulates the thickness of the developer forming a layer on the developer carrier. The ratio of a dynamic torque W (kgf·cm) to act on the developer while the developing device is in operation to an amount of toner grains M (g) contained in the developer is selected to be $4.0\times10^{-2}$ or below.

A developing device for practicing the above method and an image forming apparatus including the developing device are also disclosed.

BRIEF DESCRIPTION OF THE DRAWINGS

The above and other objects, features and advantages of the present invention will become more apparent from the following detailed description taken with the accompanying drawings in which:

FIG. 5 is a table listing the results of evaluation conducted with Example 1 of the present invention as to background contamination and toner scattering; and FIG. 6 is a table listing the results of evaluation conducted with Example 2 through 10 of the present invention and Comparative Examples 1 through 3.

DESCRIPTION OF THE PREFERRED EMBODIMENT

After a series of studies and experiments, we found that a dynamic torque exerted by a developing unit on a developer and the weight and toner content of the developer had decisive influence on the burying of an outside substance covering toner grains. We further found that a more desirable effect was achievable without any side effect if the configurations of carrier grains and toner grains were limited.

Figure 1:
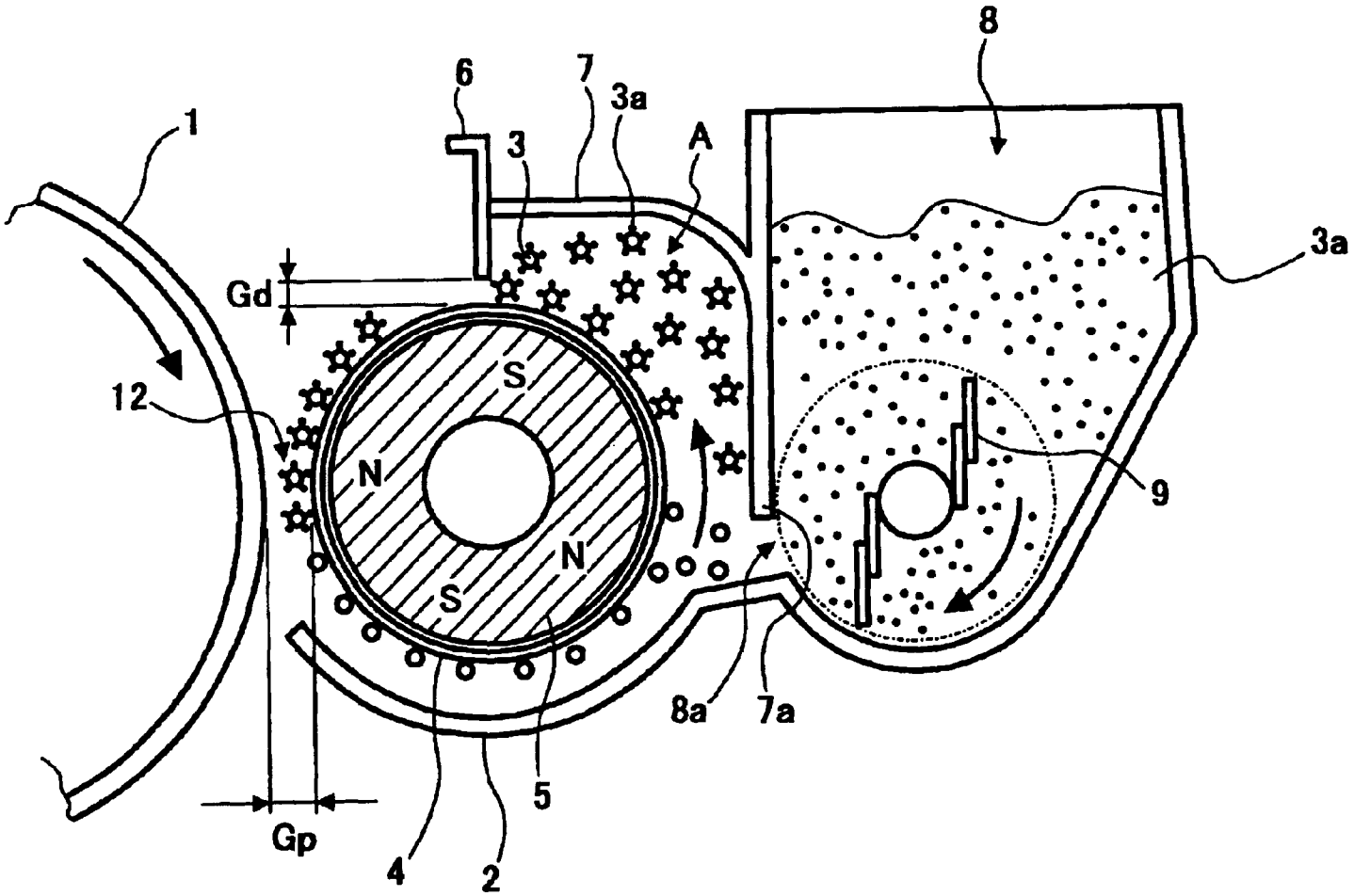
FIG. 1 is a fragmentary section showing a developing device in accordance with the present invention.

Referring to FIG. 1 of the drawings, a developing device in accordance with the present invention and included in an image forming apparatus is shown. In FIG. 1, the reference numeral 1 designates a photoconductive drum or image carrier having an OPC (Organic PhotoConductor) or similar photoconductive layer on its surface and rotatable in a direction indicated by an arrow (clockwise). A charger and an exposing unit, not shown, are arranged upstream of the developing device in the direction of rotation of the drum 1. The charger and exposing unit form a latent image on the surface of the drum 1.

As shown in FIG. 1, the developing device includes a case 2 in which a sleeve or developer carrier 4 is disposed. The case 2 stores a developer 3 made up of toner grains 3*a* and carrier grains. A stationary magnet roller 5 is accommodated in the sleeve 4 and provided with a plurality of magnetic poles N and S. The magnet roller 5 causes the developer 3 to magnetically deposit on the sleeve 4. The sleeve 4, rotating in a direction indicated by an arrow (counterclockwise), conveys the developer deposited thereon. The N and S poles of the magnet roller 5 each have a suitable flux density for thereby causing the developer 3 to form a magnet brush on the sleeve 4. A doctor blade or metering member 6 meters the developer 3 deposited on the sleeve 4, thereby regulating the height and amount of the magnet brush. There are also shown in FIG. 1, a penthouse 7 preceding the doctor blade 6, a partition 7*a*, a toner hopper 8, a port 8*a* for replenishing fresh toner, a feed roller 9, a developing zone 12, and a chamber A for feeding the developer 3.

In operation, the fresh toner introduced in the toner hopper 8 is evenly distributed in the developer 3 and then fed to the case 2 by the feed roller 2. The developer 3 is then deposited on the sleeve 4 and conveyed thereby in the direction indicated by the arrow in FIG. 1. At this instant, the toner grains and carrier grains density gather in the narrow gap between the doctor blade 4 and the sleeve 4, so that the toner grains are charged by friction. At the same time, the doctor blade 6 causes the developer 3 to form a layer having uniform thickness on the sleeve 4. The developer 3 is then conveyed to the developing zone 12 by the sleeve 4. The magnet brush formed on the sleeve 4 moves together with the sleeve 4 while oscillating due to the variation of the flux density. While the developer 3 is smoothly conveyed via the developing zone 12, the toner grains are transferred from the sleeve 4 to a latent image formed on the drum 1, thereby producing a corresponding toner image. For this purpose, a bias for development is applied between the sleeve 4 and the core of the drum 1.

When the developer 3 passes the doctor blade 6, an outside substance covering the surfaces of the toner grains are buried in the toner grains due to intense friction, as stated earlier. A series of researches and experiments showed that when the doctor blade 6 was absent, the outside substance was buried little and caused a minimum of change in the characteristics of the developer.

When the outside substance is buried in the toner grains, not only the fluidity of the toner grains decreases and brings about defective charging, but also so-called carrier spent is accelerated. Carrier spent refers to the deposition of the resin component or the parting agent of the toner grains on the carrier grains. Such occurrences bring about background contamination and toner scattering with the elapse of time, preventing image quality from remaining stable over a long time.

In accordance with the present invention, to reduce the burying of the outside substance in the toner grains, the ratio of a dynamic torque W (kgf·cm) to act on the developer 3 during operation to the amount M (g) of toner contained in the developer 3, i.e., W/M is selected to be $4.0\times10^{-2}$ or less. A dynamic torque is produced by subtracting the torque of the developing device measured when the developer is absent therein from the torque of the same measured when the developer is present. In this sense, a dynamic torque refers to the size of a pure dynamic torque acting on the developer present in the developing device.

The size of stress to act on the toner of the developer is proportional to the size of the dynamic torque mentioned above. In addition, the size of the stress is effected by the amount of toner present in the developing device as well. For example, for a given developing device, the burying of the outside substance in the toner grains is slower when the toner content of the developer is high than when it is low. Further, although the torque to act on the developer in the developing device increases with an increase in the amount of the developer, the burying of the outside substance is not accelerated in proportion to the amount of the developer. Presumably, the total amount of toner present in the developer has influence on the above phenomena, i.e., the size of the stress to act when the developer passes the doctor blade 6 is distributed to the toner grains.

In accordance with the present invention, the dynamic torque at the developing device side is adjusted on the basis of the arrangement of the magnetic poles of the magnet roller 5, a doctor gap between the doctor blade 6 and the sleeve 4, the configuration of the doctor blade 6 and so forth. At the same time, the weight and toner content of the developer are adequately selected for thereby adjusting the ratio W/M.

The developer applicable to the present invention will be described specifically hereinafter.

In accordance with the present invention, to produce the toner grains, a mixture consisting at least of binder resin and colorant are kneaded in a thermal roll mill, solidified by cooling, and then pulverized and classified to prepare mother grains. Subsequently, the mother grains and a coating agent are mixed in, e.g., a Henschel mixer, so that the coating agent is coated on the mother grains.

The binder resin for the toner grains may be any one of binder resins customarily applied to toners and including, e.g., a monomer of polystyrene, polychlorostyrene, polyvinyl toluene or similar styrene or a substitution thereof, styrene/p-chlorostyrene copolymer, styrene/propylene copolymer, styrene/vinyltoluene copolymer, styrene/vinylnaphthalene copolymer, styrene/methyl acrylate copolymer, styrene/ethyl acrylate copolymer, styrene/butyl acrylate copolymer, styrene/octyl acrylate copolymer, styrene/methyl methacrylate copolymer, styrene, ethyl methacrylate copolymer, styrene/butyl methacrylate copolymer, styrene/α-methyl chloromethacrylate, styrene/acrylonitrile copolymer, styrene/vinylmethyl ether copolymer, styrene/vinylethyl ether copolymer, styrene/vinylmethylketone copolymer, styrene/butadien copolymer, styrene/isoprene copolymer, styrene/acrylonitrile/indene copolymer, styrene/maleic acid copolymer, styrene/maleic acid ester or similar styrene copolymer, poly(methyl methacrylate), poly(butyl methacrylate), polyvinyl chloride, polyvinyl acetate, polyethylene, polypropylene, polyester, polyvinyl butyral, polyacrylic resin, rosin, modified rosin, terpene resin, phenol resin, chlorinated paraffin, or paraffin wax. Two or more of such binder resins may be combined.

The colorant may be implemented by any one of conventional colorants applied to toners. Colorants for black include carbon black, Aniline Black, furnace black, and lamp black. Colorants for cyan include Phthalocyanine Blue, Methylene Blue, Victoria Blue, Methyl Violet, Aniline Blue, and Ultramarine Blue. Colorants for magenta include Rhodamine 6G Lake, dimethyl quinacrydone, Watching Red, Rose Bengal, Rhodamine B, and Arizarine Lake. Colorants for yellow include Chrome Yellow, Bendizine Yellow, Hansa Yellow, Naphtole yellow, and Molybdenum Yellow, Quinoline Yellow.

If desired, a small amount of charge depositing agent, e.g., dye or pigment and a small amount of charge control agent may be added in order to promote efficient charging of the toner grains. The charge control agent may be any one of, e.g., a metal complex of monoazo dye, a Co, Cr, Fe or similar metal complex of salisylic acid, naphthoic acid or dicarbonate, organic dye, and tetraammonium salt.

In accordance with the present invention, the ratio of the mean amount of charge q1/m1 ($\mu$C/g) of the toner mother grains to the mean amount of charge q2/m2 ($\mu$C/g) of the final toner grains covered with the outside substance should preferably be 0.80 or above. With this ratio (q1/m1)/(q2/m2), it is possible to allow a minimum of change to occur in charging characteristic when the outside substance is buried in the toner mother grains, thereby preserving the advantages of the present invention stably over a long time.

In accordance with the present invention, the mean amount of charge of the toner mother grains and that of the final toner grains are measured by blow-off measurement with given mother grains and corresponding toner grains covered with the outside substance mixed with the same carrier grains under the same conditions.

In accordance with the present invention, to reduce the influence of the burying of the outside substance, a large amount of outside substance may be deposited on the mother grains beforehand, if desired. Particularly, experiments showed that when the amount of outside substance was 1.0 parts by weight or above with respect to the mother grains, the outside substance was not buried over a certain level even when subjected to stress inside the developing device, decelerating the deterioration of the charging characteristic. It is to be noted that when two or more different kinds of outside substances are used, the amount of outside substance mentioned above refers to the total amount of such outside substances.

In accordance with the present invention, the outside substance contains at least two different kinds of inorganic fine grains for lowering the degree of burying.

For the inorganic fine grains, use may be made of any one of silica, alumina, titanium oxide, barium titanate, magnesium titanate, sodium titanate, strontium titanate, ion oxide, copper oxide, zinc oxide, tin oxide, siliceous sand, clay, mica, chromium oxide, cerium oxide, Indian red, antimony trioxide, magnesium oxide, zirconium oxide, barium sulfate, barium carbonate, sodium carbonate, silicon carbonate, and silicon nitride. Among them, in accordance with the present invention, silica and titanium oxide should preferably be used to reduce burying and to stablize charging.

In accordance with the present invention, the mean primary grain sizes of the two kinds of inorganic grains should preferably be different from each other. In this condition, the inorganic grains with a larger mean grain size play the role of spacers when the surfaces of the toner grains contact the surface of the drum or the surfaces of the carrier grains, thereby preventing the inorganic grains with a smaller mean grain size from being buried in the toner grains. Consequently, the initial condition in which the outside substance is coated on the toner mother grains is maintained over a long time, so that the advantages of the present invention are preserved. When the amount of the inorganic grains with a larger grain size is small, as the amount of the inorganic grains with a smaller grain size increases, the variation of the toner characteristics due to aging becomes inconspicuous. This is presumably because the inorganic grains with a larger grain size are buried in the mother grains first.

More specifically, in accordance with the present invention, at least one kind of inorganic fine grains should preferably have a mean primary grain size of 0.03 $\mu$m or below from the fluidity standpoint. Should the mean primary grain size be above 0.03 $\mu$m, toner charging would be irregular due to short fluidity. The other kind of inorganic fine grains should preferably have a mean primary grain size of 0.2 $\mu$m or below for the following reason. Although the inorganic grains with the mean primary grain size of 0.03 $\mu$m or below implements a certain degree of fluidity, the inorganic grains with a mean primary grain size of above 0.2 $\mu$m are likely to render toner charging irregular due to short fluidity, as stated above.

When the outside substance consists of three or more different kinds of inorganic fine grains, the advantages of the present invention are achievable so long as two of them satisfy the above relation.

The carrier grains with which the present invention is practicable will be described hereinafter. In accordance with the present invention, the carrier grains consist of coated or non-coated magnetic core grains. As for the core grains, use may be made of any conventional magnetic substance, e.g., iron, cobalt, nickel or similar ferromagnetic metal or magnetite, hematite, ferrite or similar alloy or compound.

Resin for coating the toner grains may be any polyethylene, polypropylene, chlorinated polyethylene, chlorosulfonated polyethylene or similar polyolefin; polystyrene, acrylic resin (e.g., polymethyl methacrylate), polyacrylonitrile, polyvinyl acetate, polyvinyl butyral, polyvinyl chloride, polyvinyl carbazole, polyvinyl ether, polyvinyl ketone or similar polyvinyl or polyvinylidene resin; vinyl chloride/vinyl acetate copolymer; styrene/acrylate copolymer, straight silicone resin or similar silicon resin with organosiloxane coupling or a modification thereof (modified by, e.g., alkyd resin, polyester, epoxy resin or polyurethane); polytetrafluoroethylene, polyfinyl fluoride, polyvinylidene fluoride, polychlorotrifluoroethylene or similar fluorocarbon resin; polyethylene terephthalate or similar polyester; polyurethane; polycarbonate; urea, formaldehyde or similar amino resin; and epoxy resin.

Among the above resins, acrylic resin, silicone resin or modifications thereof and fluorocarbon resin are particularly desirable from the toner spent standpoint. Especially, silicone resin or a modification thereof is preferable. To form the coating layer, the resin may be coated on the carrier core grains by spraying, dipping or similar conventional technology.

Fine powder maybe added to the coating layer in order to adjust, e.g., the resistance of the carrier grains. The fine powder should preferably have a grain size ranging from about 0.01 $\mu$m to about 5.0 $\mu$m and should preferably be added by 2 parts to 30 parts, particularly 2 parts to 30 parts, for 100 parts of the coating resin. For such fine powder, use may be made of alumina, titania or similar metal oxide or carbon black or similar pigment.

In accordance with the present invention, an excellent result is achievable when the carrier grains have a weight mean grain size of 40 $\mu$m or below. This is because the carrier surface area for a unit weight increases with a decrease in carrier grain size, increasing the probability of contact of the toner and carrier grains and therefore further stabilizing the amount of charge. In addition, it was experimentally found that a smaller carrier grain size was effective to cope with toner scattering ascribable to the high toner content of the developer, which is unique to the present invention.

To measure the carrier grain size, there may be used a microtrack grain analyzer available from LEEDS & NORTHRUP. A weight mean grain size Dv is expressed as:

$$Dv=\{1/\Sigma(nd^3)\}\times\{\Sigma(\text{total volume of grains present on } k \text{ channels})\times \text{middle grain size on } k \text{ channels}\}$$

Figure 2:
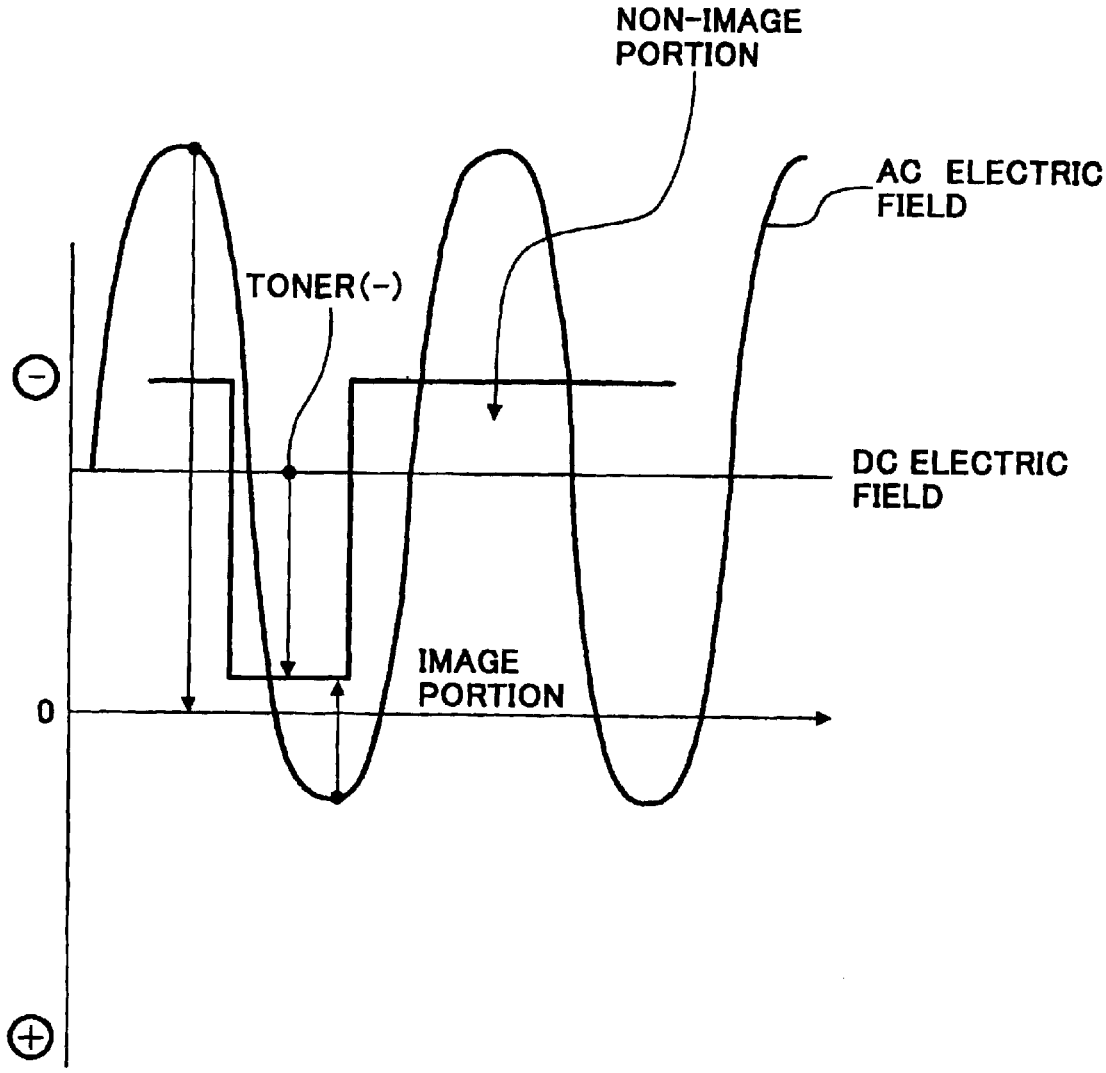
FIG. 2 shows a condition wherein an alternating electric field formed by AC and DC is formed in a reversal development system.

Further, in accordance with the present invention, an electric field to be formed between the sleeve and the drum for development should preferably be an alternating electric field formed by AC and DC superposed on each other. FIG. 2 shows an alternating electric field formed by AC and DC in a reversal development system. As shown, the alternating electric field causes the toner grains on the drum to move in such a manner as to oscillate, so that the toner grains are faithfully arranged on the latent image. In this sense, the alternating electric field is an excellent measure for outputting attractive images even when the amount of charge of the toner grains becomes unstable due to the burying of the outside substance. This insures high quality image over a long time.

Figure 3:
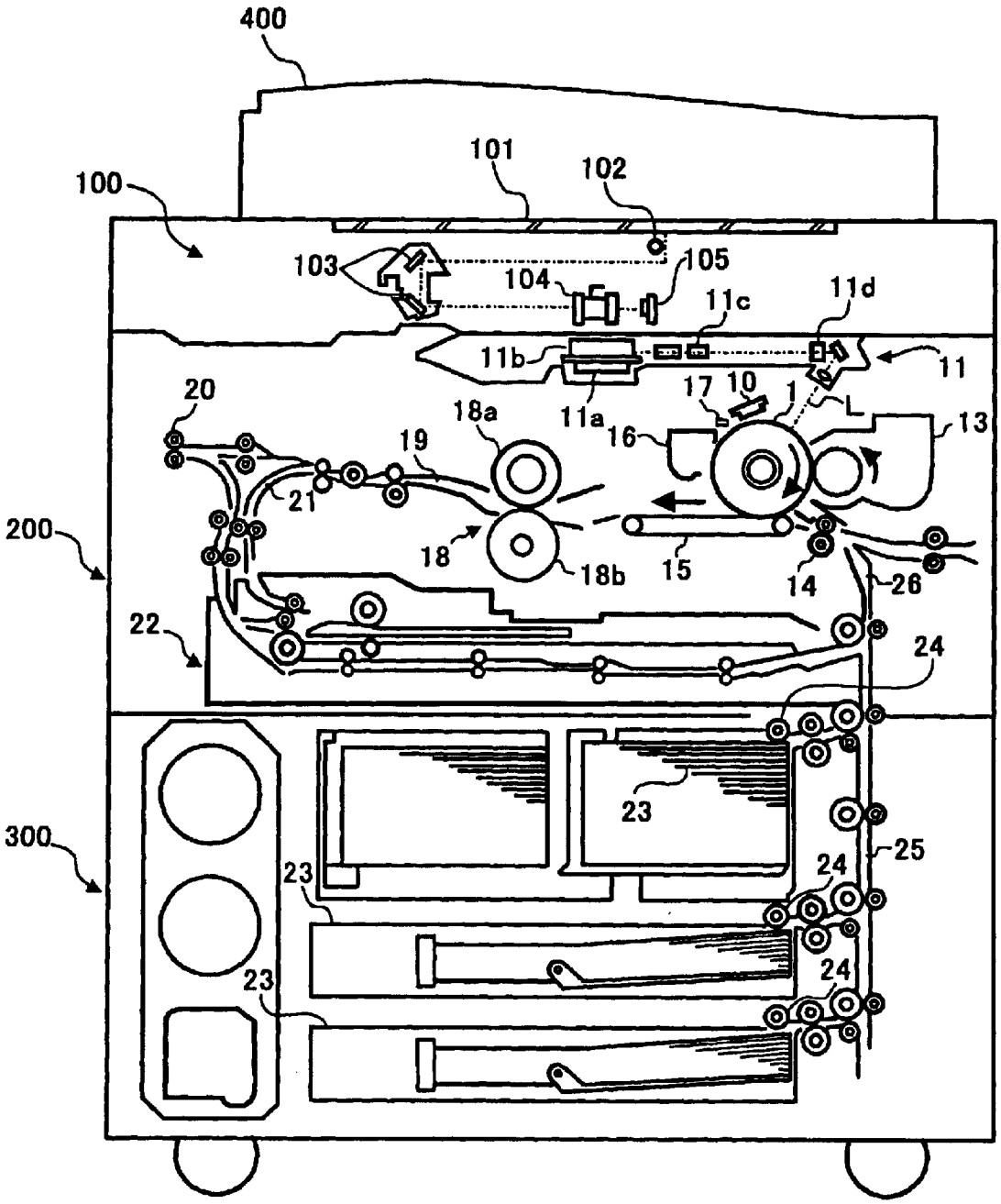
FIG. 3 shows a specific configuration of an image forming apparatus to which the present invention is applicable.

Reference will be made to FIG. 3 for describing a specific construction of an image forming apparatus including the developing device of the present invention and implemented as a copier by way of example. It is to be noted that an image forming apparatus to which the present invention is applicable is not limited to an electrophotographic image forming apparatus described above, but also to an image forming apparatus using any other conventional process so long as it satisfies the conditions of the present invention. As shown, the copier is generally made up of a document scanning section 100, an image forming section 200, and a sheet feeding section 300.

The document scanning section 100 includes a light source 102, a movable mirror 103, a lens 104, and an image sensor 105. When a document is fed from an ADF (Automatic Document Feeder) 400 to a glass platen 101, the document scanning section 100 scans the document and converts a document image to image data.

The image forming section 200 includes a photoconductive drum or image carrier 1. Arranged around the drum 1 are a charger 10, an optical writing unit or exposing unit 11, a developing device 13, a belt unit 15, a cleaning unit 16, and a discharger 17. A fixing unit 18 including a heat roller 18*a* and a press roller 18*b*, a sheet path 19 and an outlet roller pair 20 are arranged downstream of the belt unit 15 in the direction of sheet conveyance. The reference numerals 21 and 22 designate a sheet path 21 and a tray 22 assigned to a duplex print mode.

The sheet feeding section 300 includes a plurality of sheet trays 23 each being loaded with a stack of sheets of particular size. A pickup roller 24 is associated with each of the sheet trays 23. A sheet path 25 extends from the sheet trays 23 to a registration roller pair 14.

In the image forming section 200, the charger 10 uniformly charges the surface of the drum 1 in the event of image formation. The charger 10 may be implemented as any one of conventional chargers including a corona charger, a charge roller and a solid-state charger. The optical writing unit 11 scans the charged surface of the drum 1 with a light beam in accordance with image data output from the document scanning section 100. The optical writing unit 11 includes a semiconductor laser or similar light source, not shown, a polygonal mirror 11*b* driven by a motor 11*a*, and optics 11*c* and 11*d*. Alternatively, the optical writing unit 11 may use an LED (Light Emitting Diode) array and a microlens array, if desired.

The developing device 13 has the configuration described with reference to FIG. 1 and develops a latent image formed on the drum 1 with the toner of a two-ingredient type developer, which is deposited on the sleeve 4, thereby producing a corresponding toner image. A sheet or recording medium is fed from the sheet feeding section 300 to the belt unit 15 via the registration roller pair 14. The toner image is transferred from the drum 1 to the sheet being conveyed by the belt unit 15. The sheet with the toner image is conveyed by the belt unit 15 to the fixing unit 18. In the fixing unit 18, the heat roller 18*a* and press roller 18*b* fix the toner image on the sheet with heat and pressure while nipping it therebetween. The sheet with the fixed toner image is driven out of the copier to a copy tray, not shown, via the sheet path 19 and outlet roller pair 20. The cleaning unit 16 removes toner, paper dust and other impurities left on the drum 1 after the image transfer. Subsequently, the discharger 17 discharges the surface of the drum 1 to thereby prepare it for the next image formation.

The present invention is similarly applicable to any conventional color image forming apparatus using toners of two or more different colors, e.g., one of the type including a single photoconductive drum and a plurality of developing devices arranged around the drum. This type of image forming apparatus repeats charging, exposure and development a number of times corresponding to the number of colors to thereby sequentially form, e.g., a yellow, a magenta, a cyan and a black toner image on the drum one above the other. The resulting color image is transferred from the drum to a sheet or similar recording medium.

Another type of conventional color image forming apparatus includes a single photoconductive drum, four developing devices, and an intermediate image transfer belt or body. In this type of apparatus, a yellow, a magenta, a cyan and a black toner image, for example, are sequentially formed on the drum while being sequentially transferred to the intermediate transfer belt one above the other, completing a color image. Subsequently, the color image is transferred from the intermediate image transfer belt to a sheet. Further, a tandem image forming apparatus includes a plurality of image forming sections arranged side by side and transfers, e.g., a yellow, a magenta, a cyan and a black toner image from the image forming sections to a sheet either directly or by way of an intermediate image transfer body one above the other.

Figure 4:
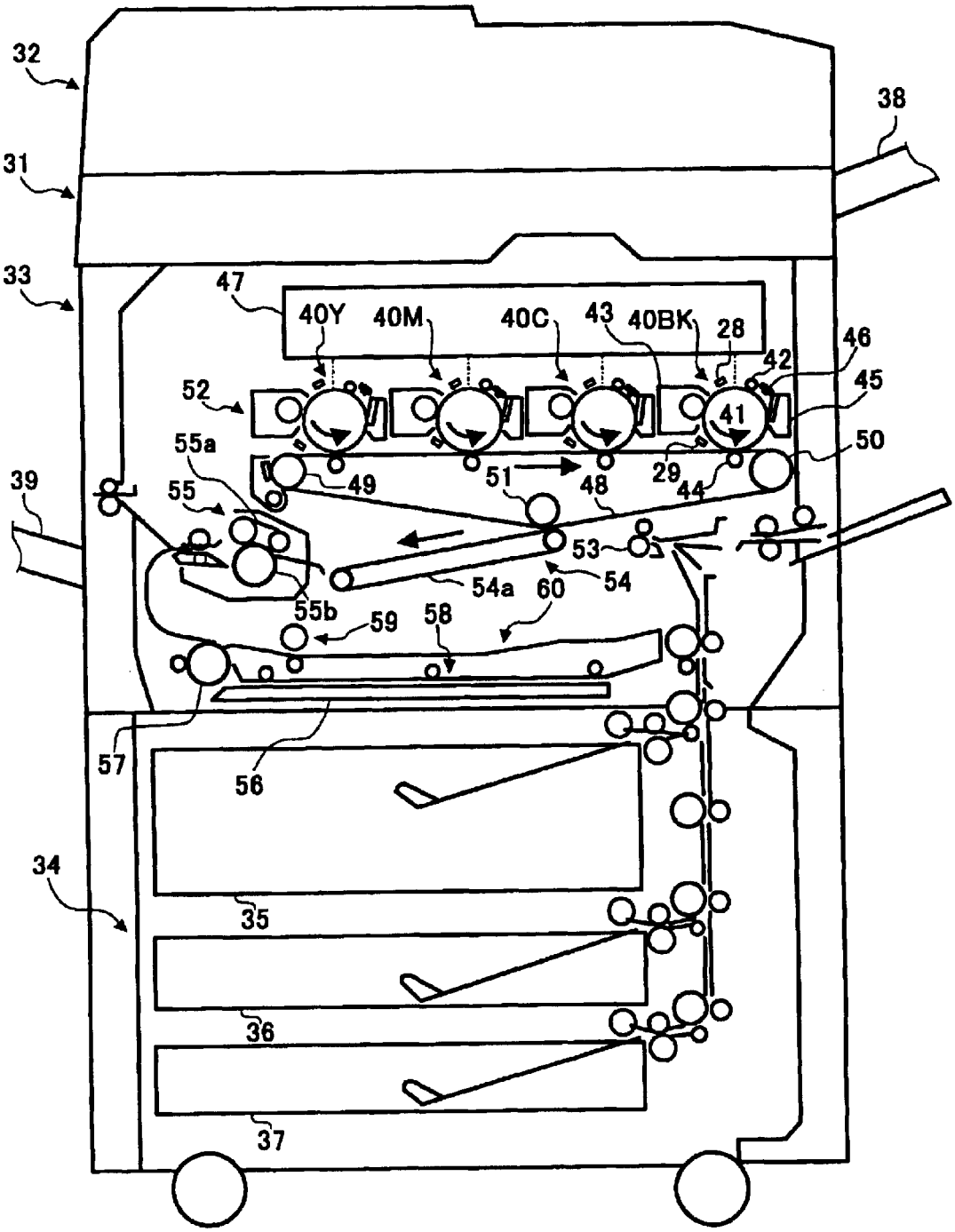
FIG. 4 shows another specific configuration of the image forming apparatus to which the present invention is applicable.

FIG. 4 shows another specific configuration of the image forming apparatus to which the present invention is applicable. As shown, the image forming apparatus is implemented as a tandem color copier including a document scanning section (scanner hereinafter), an ADF 32, a color image forming section 33, and a sheet feeding section 34. The color image forming section 33 includes a plurality of image forming sections 40Y, 40M, 40C and 40Bk arranged side by side and assigned to yellow (Y), magenta (M), cyan (C) and black (Bk), respectively. The sheet feeding section 34 includes sheet cassettes 35, 36 and 37 each being loaded with sheets of particular size. The color copier is capable of forming any one of monochromatic images, bicolor or tricolor images and full-color images, as desired. The scanner 31 is substantially identical in configuration with the image scanning section 100 of FIG. 3. The difference is that the scanner 31 reads a document image color by color with, e.g., a color CCD (Charge Coupled Device) image sensor, sending the resulting image signals to a signal processor not shown. The signal processor converts the image signals to, e.g., Y, M, C and Bk image signals and sends the Y through Bk image signals to an optical writing unit 47, which is included in the image forming section 33.

The image forming sections 40Y through 40Bk include respective photoconductive drums or image carriers 41 spaced from each other at preselected intervals in the horizontal direction. The image forming sections 40Y. through 40Bk are identical in configuration with each other except for color. A charge roller 42, a developing unit 43, a primary image transfer roller 44, a cleaning unit 45 and a quenching lamp 46 are arranged around each of the drums 41.

The optical writing unit 47 is positioned above the drums 41 and may include four laser optics each including a respective laser diode (LD) as a light source. Laser beams issuing from the LDs are steered by a single deflector, and each scans the surface of one of the four drums 41.

In the image forming sections 40Y through 40Bk, the developing units 43, which may have the configuration of FIG. 1 each, store two-ingredient type developers made up of carrier grains and Y, M, C and Bk toner grains, respectively. There are also shown in FIG. 4 a potential sensor 28 responsive to the surface potential of the drum 41 associated therewith, and an image density sensor 29 responsive to the image density of a toner image formed on the drum 41. However, the sensors 28 and 29 are not essential with the present invention.

An intermediate image transfer belt (simply belt hereinafter) 48 is positioned below the drums 41 and held in contact with the drums 41 at positions where the primary image transfer rollers 44 are located. While the belt 48 is shown as being passed over three support rollers 49, 50 and 51, it may be passed over four or more rollers including a roller configured to obviate the offset of the belt 48.

The primary image transfer rollers 44 are pressed against the drums 41 via the belt 48. The image transfer rollers 44 may, of course, be replaced with image transfer brushes or non-contact image transfer chargers, if desired. A belt cleaning unit 52 adjoins part of the belt 48 passed over the support roller 49. One of the rollers over which the belt 48 is passed, e.g., the support roller 51 faces a secondary image transfer unit or secondary image transferring means 54 via the belt 48. The secondary image transfer unit 54 is implemented as a belt 54*a* passed over two support rollers. The belt 54*a* may also be replaced with an image transfer roller or an image transfer charger, if desired.

The belt 54*a* conveys a sheet or recording medium to a fixing unit 55. The fixing unit 55 includes an endless fixing belt 55*a* passed over two rollers and a press roller 55*b* pressed against the fixing belt 55*a*. The fixing unit 55 is positioned below the belt 48. A duplex copy unit 56 for a duplex copy mode extends in the horizontal direction below the fixing unit 55 and belt 54*a*. The duplex copy unit 56 includes a turn roller 57, a feed roller 59, and a plurality of roller pairs 58 for conveyance.

In operation, the ADF 32 feeds a document from an ADF tray, not shown, to a glass platen included in the scanner 31. The scanner 31 reads the document color by color while sending the resulting color image signals to the signal processor. The signal processor converts the input image signals to Y, M, C and Bk image data and sends the Y through Bk image data to the optical writing unit 47, as stated earlier.

In the image forming section 33, the charge rollers 42 each uniformly charge the surface of one drum 41 associated therewith and rotating counterclockwise, as indicated by an arrow in FIG. 4. The optical writing unit 47 exposes the charged surfaces of the drum 41 with laser beams in accordance with the Y, M, C and Bk image data, thereby forming latent images on the drums 41. The developing units 43 each develop the latent image formed on the associated drum 41 with the toner of a particular color. The resulting toner images are sequentially transferred from the drums 41 to the belt 48 one above the other, forming a full-color image.

A sheet is fed from the sheet feeding section 34 and temporarily stopped at the nip of the registration roller pair 53. The registration roller pair 53 starts conveying the sheet such that the leading edge of the sheet meets the leading edge of the full-color image formed on the belt 48 at the secondary image transfer station. At the secondary image transfer station, the secondary image transfer unit 54 transfers the full-color image from the belt 48 to the sheet. Subsequently, the belt 54*a* conveys the sheet carrying the toner image to the fixing unit 55. The fixing belt 55*a* and press roller 55*b* of the fixing unit 55 fix the toner image on the sheet. Finally, the sheet with the fixed toner image is driven out of the copier to a copy tray 39.

The present invention is similarly applicable to a tandem image forming apparatus not using the intermediate image transfer belt 48 as well as to the other various color image forming apparatuses stated earlier. If desired, image data may be written to a RAM (Random Access Memory), ROM (Read Only Memory), CD-R (Compact Disk Recordable), CD-RW (CD ReWritable) magnetic disk or similar image memory, so that the image data can be read out and sent to the image forming section, as needed. In this sense, the present invention is, of course, applicable even to an image forming apparatus of the type writing data received from, e.g., a personal computer in a memory and sending them to an image forming section later. Typical of this type of image forming apparatus is an LED printer or an LBP (Laser Beam Printer) known in the art.

Specific examples of the present invention and comparative examples will be described hereinafter. It is to be noted that a term "parts" to repeatedly appear hereinafter refers to parts by weight without exception.

EXAMPLE 1

As for carrier grains, 100 parts of silicone resin solution, 4 parts of carbon black and 100 parts of toluene were dispersed for 30 minutes in a homo mixer to thereby prepare a coating layer forming liquid. This liquid was coated on 1,000 parts of ferrite grains having a volume mean grain size of 50 $\mu$m by a fluid-bed type coater, thereby preparing coated carrier grains.

As for toner grains, 80 parts of polyester resin, 20 parts of styrene-methylacrylate copolymer, 5 parts of carnauba wax, 8 parts of carbon black and 3 parts of metal-containing monoazo dye were sufficiently mixed in a Henschel mixer, melted in a roll mill at 130° C. to 140° C. for about 30 minutes, cooled off to room temperature, and then pulverized and classified by a jet mill. As a result, toner mother grains having a mean grain size of 8 $\mu$m were prepared.

When 0.5 g of the toner mother grains and 9.5 g of the carrier grains were agitated in a roll mill for 10 minutes, the grains had a mean amount of charge q1/m1 of −18.0 $\mu$C/g.

Subsequently, 100 parts of the toner mother grains and 0.8 part of silica AEROSIL TT600 (trade name), which is a fluidizing agent available from NIPPON AEROSIL, were mixed in a Henschel mixer to thereby produce final toner grains.

When 0.5 g of the toner grains and 9.5 g of the carrier grains were agitated in a roll mill for 10 minutes, the grains had a mean amount of charge q2/m2 of −23.5 $\mu$C/g. Therefore, the ratio (q1/m1)/(q2/m2) was 0.77.

7.0 parts of the toner grains and 93.0 parts of the carrier grains produced by the above procedure were mixed in a ball mill to thereby complete a two-ingredient type developer having a toner content of 7%.

For estimation, 300 g of the above developer was loaded in a black developing unit included in a printer Imagio Color 8000 available from RICOH CO, LTD; the developing unit had a doctor gap of 0.6 mm. The developing unit was then driven in the same manner as in the actual printer at a sleeve linear velocity of 185 mm/sec. In this condition, a dynamic torque of 0.80 kgf·cm acted on the developer. The ratio W/M was therefore $3.8\times10^{-2}$.

In Example 1, to measure a dynamic torque, use was made of a miniature torque converter TP-2KCE and a dynamic strain gauge DPM-711 available from KYOWA DENGYOU.

The developing unit stated above was mounted to Imagio Color 8000 and subjected to a running test in a black mode. During the running test, the toner content control was so adjusted as to maintain the initial toner content of the developer. As for developing conditions, a charge potential of −700 V was selected while a potential was −100 V in an image portion or −650 V in a non-image portion or background; an alternating electric field was not applied. As for estimation, a defective image (background contamination) and toner scattering around the developing unit were examined when 10,000 prints, 20,000 prints and 50,000 prints were output.

Background contamination and toner scattering both were observed by eye and estimated with respect to five consecutive ranks 5 through 1. Ranks 3 to 5 were regarded as allowable ranks. FIG. 5 is a table listing the results of estimation.

EXAMPLE 2

Example 2 is identical with Example 1 except that the toner content of the developer was adjusted to 10%. The dynamic torque acting on the developer was 0.77 kgf·cm, sot that the ratio W/M was $2.6\times10^{-2}$.

EXAMPLE 3

Example 3 is identical with Example 2 except that the amount of the developer loaded in the developing unit was 250 g. The dynamic torque acting on the developer was 0.74 kgf·cm, so that the ratio W/M was $3.0\times10^{-2}$.

EXAMPLE 4

Example 4 is identical with Example 2 except that use was made of ferrite grains having a volume mean grain size of 35 μm in the event of preparation of the carrier grains. The dynamic torque acting on the developer was 0.76 kgf·cm, so that the ratio W/M was $2.5\times10^{-2}$.

EXAMPLE 5

Example 5 is identical with Example 2 except that 4 parts of metal-containing monoazo pigment was used for toner. The mean amounts of charge q1/m1 and q2/m2 were −20.5 μC/g and −24.0 μC/g, respectively, so that the ratio (q1/m1)/(q2/m2) was 0.85. The dynamic torque acting on the developer was 0.76 kgf·cm, so that the ratio W/M was $2.5\times10^{-2}$.

EXAMPLE 6

Example 6 is identical with Example 2 except that 2.3 parts of fluidizing agent was used for toner. The mean amounts of charge q1/m1 and q2/m2 were −18.0 μC/g and −25.2 μC/g, respectively, so that the ratio (q1/m1) / (q2/m2) was 0.71. The dynamic torque acting on the developer was 0.77 kgf·cm, so that the ratio W/M was $2.6\times10^{-2}$.

EXAMPLE 7

Example 7 is identical with Example 6 except that 0.6 part of AEROSIL TT600 mentioned earlier and 0.5 part of silica AEROSIL RY-50 also available from NIPPON AEROSIL were used for toner. AEROSIL RY-50 had a mean primary grain size of 0.04 μm. The mean amounts of charge q1/m1 and q2/m2 were −18.0 μC/g and −24.3 μC/g, respectively, so that the ratio (q1/m1)/(q2/m2) was 0.74. The dynamic torque acting on the developer was 0.77 kgf·cm, so that the ratio W/M was $2.6\times10^{-2}$.

EXAMPLE 8

Example 8 is identical with Example 7 except that AEROSIL RY-50 was replaced with silica AEROSIL RY-200 also available from NIPPON AEROSIL and having a mean primary grain size of 0.012 μm. The mean amounts of charge q1/m1 and q2/m2 were −18.0 μC/g and −24.5 μC/g, respectively, so that the ratio (q1/m1)/(q2/m2) was 0.73. The dynamic torque acting on the developer was 0.76 kgf·cm, so that the ratio W/M was $2.5\times10^{-2}$.

EXAMPLE 9

Example 9 is identical with Example 8 except that an electric field for development was implemented as a DC −500 V biased by a rectangular AC voltage of 1,000 Vpp (peak-to-peak) having a frequency of 2 kHz.

EXAMPLE 10

Example 10 is identical with Example 9 except that ferrite grains with a volume mean grain size of 35 μm were used for the carrier while 4 parts of metal-containing monoazo pigment was used for the toner. The mean amounts of charge q1/m1 and q2/m2 were −20.5 μC/g and −25.0 μC/g, respectively, so that the ratio (q1/m1)/(q2/m2) was 0.82. The dynamic torque acting on the developer was 0.76 kgf·cm, so that the ratio W/M was $2.5\times10^{-2}$.

Comparative Example 1

Comparative Example 1 is identical with Example 1 except that the toner content of the developer was adjusted to 5%. The dynamic torque acting on the developer was 0.82 kgf·cm, so that the ratio W/M was $5.5\times10^{-2}$.

Comparative Example 2

Comparative Example 2 is identical with Example 1 except that 250 g of the developer was loaded in the developing unit. The dynamic torque acting on the developer was 0.78 kgf·cm, so that the ratio W/M was $4.5\times10^{-2}$.

Comparative Example 3

Comparative Example 3 is identical with Example 1 except that the doctor gap of the developing unit was 0.4 mm. The dynamic torque acting on the developer was 0.87 kgf·cm, so that the ratio W/M was $4.1\times10^{-2}$.

FIG. 6 is a table listing the results of estimation conducted with Examples 2 through 10 and Comparative Examples 1 through 3.

As FIGS. 5 and 6 indicate, Examples 1 through 10 in which the ratio W/M is $4.0\times10^{-2}$ or below protect the toner grains from deterioration even after a long time of running, thereby reducing both of background contamination and toner scattering. Particularly, Example 4 noticeably reduces toner scattering because the carrier grain size is 40 μm or below.

In Example 5, the ratio (q1/m1)/(q2/m2) is 0.80 or above. This also reduces background contamination and toner scattering to a noticeable degree. Also, Examples 6 through 8, which limit the amount and kind of the outside substance on the toner each, are also desirable. Example 9, which uses the alternating electric field, makes up for an uneven charge distribution ascribable to the deterioration of the toner grains. Further, Example 10 is excellent as to long-term background contamination and toner scattering.

In summary, it will be seen that the present invention provides a developing method and a developing device capable of maintaining desirable image quality by reducing the burying of an outside substance in toner grains, which would bring about background contamination and toner scattering.

Various modifications will become possible for those skilled in the art after receiving the teachings of the present disclosure without departing from the scope thereof.

What is claimed is:

1. In a method of developing a latent image formed on an image carrier with a developing device including at least a developer carrier, which magnetically causes a two-ingredient type developer made up of toner grains and magnetic carrier grains to deposit thereon and conveys said developer to a developing zone where said developer carrier faces said image carrier, and a doctor blade configured to regulate a thickness of said developer forming a layer on said developer carrier, a ratio of a dynamic torque W (kgf·cm) to act on said developer while said developing device is in operation to an amount of toner grains M (g) contained in said developer is selected to be $4.0\times10^{-2}$ or below.

2. The method as claimed in claim 1, wherein the carrier grains contained in the developer have a weight mean grain size of 40 $\mu$m or below.

3. The method as claimed in claim 2, wherein an alternating electric field is applied for developing the latent image formed on said image carrier.

4. The method as claimed in claim 1, wherein the toner grains contained in the developer consist at least of toner mother grains made up of a resin and a colorant and an outside substance covering said toner mother grains, and a ratio of a mean amount of charge q1/m1 ($\mu$C/g) of said toner mother grains to a mean amount of charge q2/m2 ($\mu$C/g) of said toner grains is 0.80 or above.

5. The method as claimed in claim 4, wherein an alternating electric field is applied for developing the latent image formed on said image carrier.

6. The method as claimed in claim 1, wherein the toner grains contained in the developer consist at least of toner mother grains made up of a resin and a colorant and an outside substance covering said toner mother grains, and an amount of the outside substance is 1.0 wt % or above with respect to the toner mother grains.

7. The method as claimed in claim 6, wherein the outside substance consists of at least two kinds of inorganic fine grains.

8. The method as claimed in claim 7, wherein the two kinds of inorganic fine grains are different in mean primary grain size from each other.

9. The method as claimed in claim 8, wherein the inorganic fine grains with a smaller mean primary grain size are larger in amount than the inorganic fine grains with a larger mean primary grain size.

10. The method as claimed in claim 9, wherein the inorganic fine grains of one kind have a mean primary grain size of 0.03 $\mu$m or below while the inorganic fine grains of the other kind have a mean primary grain size of 0.2 $\mu$m or below.

11. The method as claimed in claim 10, wherein an alternating electric field is applied for developing the latent image formed on said image carrier.

12. The method as claimed in claim 1, wherein an alternating electric field is applied for developing the latent image formed on said image carrier.

13. A developing device comprising:

a developer carrier configured to magnetically causes a two-ingredient type developer made up of toner grains and magnetic carrier grains to deposit thereon, and convey said developer to a developing zone where said developer carrier faces said image carrier; and a doctor blade configured to regulate a thickness of the developer forming a layer on said developer carrier;

wherein a ratio of a dynamic torque W (kgf·cm) to act on said developer while said developing device is in operation to an amount of toner grains M (g) contained in said developer is selected to be $4.0\times10^{-2}$ or below.

14. In an image forming apparatus for forming a latent image and developing said latent image with a developer to thereby produce a corresponding toner image, a developing device comprising:

a developer carrier configured to magnetically cause a two-ingredient type developer made up of toner grains and magnetic carrier grains to deposit thereon, and convey said developer to a developing zone where said developer carrier faces an image carrier; and a doctor blade configured to regulate a thickness of the developer forming a layer on said developer carrier;

wherein a ratio of a dynamic torque W (kgf·cm) to act on said developer while said developing device is in operation to an amount of toner grains M (g) contained in said developer is selected to be $4.0\times10^{-2}$ or below.

* * * * *